US005743333A

United States Patent [19]

Willauer et al.

[11] Patent Number: 5,743,333

[45] Date of Patent: Apr. 28, 1998

[54] EXTERNAL CASING PACKER WITH ELEMENT END SLEEVE TO COLLAR RETAINER AND METHOD

[75] Inventors: Darrin L. Willauer, The Woodlands; Wilhelm E. Benker, Houston, both of Tex.

[73] Assignee: Baker Hughes Incorporated, Houston, Tex.

[21] Appl. No.: 642,773

[22] Filed: May 3, 1996

[51] Int. Cl.[6] ..... E21B 33/127

[52] U.S. Cl. ..... 166/122; 166/134; 166/187; 285/305

[58] Field of Search ..... 166/122, 134, 166/187; 285/305, 319

[56] References Cited

U.S. PATENT DOCUMENTS

| | | | |
|---|---|---|---|
| 2,192,914 | 3/1940 | Ice . | |
| 2,854,744 | 10/1958 | Crockett . | |
| 3,326,006 | 6/1967 | Mount . | |
| 3,437,142 | 4/1969 | Conover . | |
| 3,689,112 | 9/1972 | Slator et al. | 285/39 |
| 4,426,761 | 1/1984 | Sassak | 29/447 |
| 5,197,542 | 3/1993 | Coone | 166/122 |
| 5,201,369 | 4/1993 | Berzin et al. | 166/187 |
| 5,201,554 | 4/1993 | Gagg et al. | 285/305 X |
| 5,219,185 | 6/1993 | Oddenino | 285/305 X |
| 5,219,190 | 6/1993 | Grammel, Jr. | 285/305 |
| 5,255,945 | 10/1993 | Toon | 285/305 |
| 5,362,110 | 11/1994 | Bynum | 285/319 X |
| 5,464,257 | 11/1995 | Riddles et al. | 285/305 X |
| 5,484,174 | 1/1996 | Gotoh et al. | 285/382 X |
| 5,490,694 | 2/1996 | Shumway | 285/305 |
| 5,542,716 | 8/1996 | Szabo et al. | 285/305 |

FOREIGN PATENT DOCUMENTS 2 051 180 A 1/1981 United Kingdom .

OTHER PUBLICATIONS

U.K. Search Report dated 24 Jul. 1997; 3 pp.
Inflatables Technical Unit No. 4499 (14 pp.) Aug. 1995.
Inflatable Systems (2 pp.) date unknown.

*Primary Examiner*—William P. Neuder
*Attorney, Agent, or Firm*—Browning Bushman

[57] ABSTRACT

An external casing packer 10 is provided for positioning downhole along a tubular string in a well. Packer 10 includes a mandrel 12, an elastomeric sealing element 14, and an inflation chamber 26 for inflating the sealing element into sealing engagement with the sidewall of the well. Upper collar 22 and a lower collar 24 positioned axially above and below the sealing element, respectively, and an upper end sleeve 40 and a lower end sleeve 62 of the sealing element are mechanically interconnected. One or more anti-rotational keys 44 rotational interconnect a collar with a respective sleeve. A circumferential groove 52 may be provided in the outer surface of the collar, and a similar circumferential groove 54 provided in the inner surface of the end sleeve. A retaining wire 46 may be passed through a hole 56 in the end sleeve and into the grooves to axially interconnect the collar with the end sleeve. The interconnection mechanism of the present invention does not rely upon welding, and may be reliably used when there is relatively little spacing between the outer diameter of the mandrel and the outer diameter of the packer body.

28 Claims, 2 Drawing Sheets

EXTERNAL CASING PACKER WITH ELEMENT END SLEEVE TO COLLAR RETAINER AND METHOD

FIELD OF THE INVENTION

The present invention relates to packers of the type commonly used in petroleum recovery operations. More particularly, this invention relates to an inflatable packer with a fluid pressurized element, and to an improved technique for securing the sealing element end sleeve to a collar.

BACKGROUND OF THE INVENTION

External casing packers are widely used in petroleum recovery operations to sealingly engage either the internal surface of a casing in a wellbore, or the surface of the uncased bore. An external casing packer is coupled within a casing string, and utilizes a mandrel with a bore comparable to the bore of the casing string. The packer is thus run in as an integral part of the casing string, and provides a seal between the casing and the wellbore. The packer is commonly used in cementing operations to secure the casing string in the wellbore.

The elastomeric sealing element of an external casing packer is typically expanded by hydraulically pumping fluid down the casing to form a positive, hydro-mechanical seal between the casing and the formation. Alternatively, various downhole inflation tools as are well known in the art may be used to inflate an external casing packer. The hydraulically set sealing element engages the cylindrical internal surface of the casing or conforms to the irregular contour of the open hole, and seals off against the formation to prevent communication. An inflatable casing packer may also be used in non-cementing applications, and in such applications is typically set in an inflated position for the useful life of the well. The sealing element may employ metal ribs to safely increase packer working pressure without leakage or rupture. An exemplary external casing packer is disclosed in U.S. Pat. No. 3,437,142.

The packer elastomeric sealing member includes respective upper and lower metal end sleeves which are interconnected with the elastomeric seal or boot, and optionally may also include the metal ribs. Each metal end sleeve typically extends radially outward to the O.D. of the packer body. Upper and lower collars are provided above and below the elastomeric sealing member, and also extend to the O.D. of the packer body. Either the upper collar or the lower collar may be equipped with one or more valves which regulate fluid flow during setting of the packer, and is thus often referred to as the valve collar. Each metal end sleeve is axially and rotationally interconnected with its respective collar for reliable inflation of the packer.

Various techniques have been used for securing the upper and lower end sleeves of the packer elastomeric member with the respective upper and lower collar. In some cases, the sealing member end sleeve and a radially inward and overlapping portion of the collar may be threaded together. In many applications, however, there is simply not sufficient radial room between the O.D. of the mandrel and the desired O.D. of the packer body to accommodate threads of the desired size while allowing for sufficient remaining material to prevent failure when high axial or torque loads are applied to the packer. Also, a threaded connection between the sleeve and the collar may tend to back off or unthread once the tool is operated downhole. It is customary to weld the end sleeve to the collar to ensure the desired connection. In many cases, this welding technique reliably secures each end of the elastomeric sealing member to the collar. A significant disadvantage of this welding technique occurs when the collar and/or the end sleeve are fabricated from materials which resist corrosion, such as metals containing more than ten percent (10%) chrome. Welding of such high chrome materials is very difficult and time consuming, and frequently results in a heat affected zone that exceeds the maximum hardness specified by corrosion standards. When the collar and/or the end sleeve are fabricated from high strength steel alloys, post-weld heat treatments are commonly necessary to increase the reliability of the welded connection. Also, when the sleeve is welded to the collar prior to testing the packer, more time and expense are associated with removing this weld before a failed packer can be repaired.

U.S. Pat. Nos. 2,192,914, 2,854,744, 3,326,006, 3,689,112 and 4,426,761 disclose swaging techniques for interconnecting lengths of conduit, tubing or pipe.

The disadvantages of the prior art are overcome by the present invention. An improved external casing packer includes novel techniques for interconnecting the elastomeric sealing element end sleeve with the collar. The end sleeve and collar may be reliably and inexpensively interconnected without welding of components, thereby reducing stress corrosion cracking and increasing the useful life of the packer.

SUMMARY OF THE INVENTION

An external casing packer includes an elastomeric sealing element radially outward of a mandrel. The mandrel has a bore therethrough which is sized close to the bore of the casing string in which the packer is placed, so that the packer does not restrict the passage of wireline tools or work strings through the casing and past either the set or unset packer. Each sealing element includes an upper and lower end sleeve. Each end of the elastomeric material is secured to the sleeve, and metal ribs which increase the working pressure of the packer may also be secured at each end to the end sleeve. Collars are provided both above and below the elastomeric sealing element and radially outward of the mandrel. Either the upper or the lower collar may include one or more valves for regulating fluid flow to the pressurizing chamber to set and unset the packer.

According to one embodiment, a lower end of the upper collar fits radially within the I.D. of the upper sleeve. A plurality of circumferentially spaced notches are cut in the outer surface of the upper collar, and a similar number of axially elongate slots are formed in the upper end of the end sleeve. An anti-rotation key is placed within each notch and extends radially outward from the O.D. of the lower end of the collar. The keys are aligned with respective slots, and the collar moved axially within the end sleeve until the keys engage the end of the slots. The keys thus prevent rotation of the end sleeve with respect to the collar, and therefore allow torque to be transmitted from the mandrel to the collar, then from the collar to the end sleeve and the elastomeric sealing element.

The collar may also include a circumferential groove cut in its outer surface. A similar circumferential groove is cut in the inner surface of the end sleeve. When the anti-rotation keys bottom out in their respective slots, the grooves are axially aligned. An insertion hole is provided through the wall of the end sleeve and is aligned with the circumferential groove in the end sleeve. A wire may then be inserted through this hole into the axially aligned circumferential grooves, thereby axially securing the upper collar with the upper end sleeve. An o-ring is provided between the securing members and the elastomeric sealing member to retain fluid pressure within the pressure chamber of the packer. The lower sealing element sleeve and the lower collar may be interconnected in a similar manner.

One alternative embodiment utilizes a threaded latch mechanism to interconnect the casing packer collar with a respective sleeve at the end of the elastomeric sealing element. If disassembly of the latched collar and sleeve is desired, the collar may be rotated relative to the sleeve to unthread the latched connection. In yet another embodiment, a swaging or crimping operation is performed to interconnect the collar to the sleeve. To reinforce the swaged connection, the ends of the split ring may be welded together to form a closed ring positioned within the swaged groove.

It is an object of the present invention to provide an improved external casing packer which mechanically secures the sealing element end sleeve and a respective collar. More particularly, it is an object of the invention to axially and rotationally secure a packer sealing element end sleeve and a collar in a manner which, if desired, allows both axial and rotational loads to be reliably transmitted from the casing string to the sealing element.

It is a feature of the invention that the packer sealing element end sleeve is interconnected with the collar in a manner whereby the material characteristics of the end sleeve and the collar are not altered. Heat affected zones resulting from welding operations are avoided. The interconnection technique of this invention may thus be used with various materials, including highly corrosion resistant materials which cannot be easily welded.

It is another feature of the invention that a wire may be inserted into the circumferential grooves to axially interconnect the sealing element end sleeve and the collar, and that this wire need not be fully inserted when the packer is pressure tested. When the pressure test is positive, the wire may then be fully inserted so that it cannot thereafter practically be withdrawn. When the pressure test is negative, the partially inserted wire may be easily removed and the packer then disassembled, repaired and retested.

It is an advantage of the present invention that the inserted wire may have a rectangular cross-sectional configuration for fitting within a similarly configured combined groove between the packer sealing element end sleeve and the collar, thereby increasing the mechanical reliability of the interconnection. It is a further advantage of the invention that the configuration, size, and number of both the anti-rotational keys and the wire or other member used to prevent axial movement of the end sleeve relative to the collar may be easily altered to obtain the desired axial load and torque capabilities for the packer. Still another advantage of the invention is the significantly reduced cost associated with reliably interconnecting a packer sealing element end sleeve and a collar when fabricated from highly corrosion resistant materials.

Yet another advantage of the invention is that a threaded collet mechanism may be used for interconnecting the collar and an end sleeve of the elastomeric sealing element. The interconnection does not require rotation of either component and thus the inflatable element. Cold working of the collar or end sleeve is minimized, thereby minimizing stress corrosion. Anti-rotation keys may be used to rotationally interconnect the collar to the end sleeve. Prior to insertion of the antirotation keys, the collar may be rotated to unthread from the end sleeve, thereby disconnecting the collet mechanism if the packer fails a pressure test.

Yet another advantage of the invention is that a swage or crimping operation may be used to interconnect the collar to the end sleeve of the elastomeric sealing element. A split ring may be positioned in the swaged groove and its ends welded together to reinforce the swaged connection. If desired, the swaged connection may provide a metal-to-metal seal between the collar and the end sleeve.

These and further objects, features and advantages of the present invention will become apparent from the following detailed description, wherein reference is made to the figures in the accompanying drawings.

DETAILED DESCRIPTION OF PREFERRED EMBODIMENTS

Figure 1:
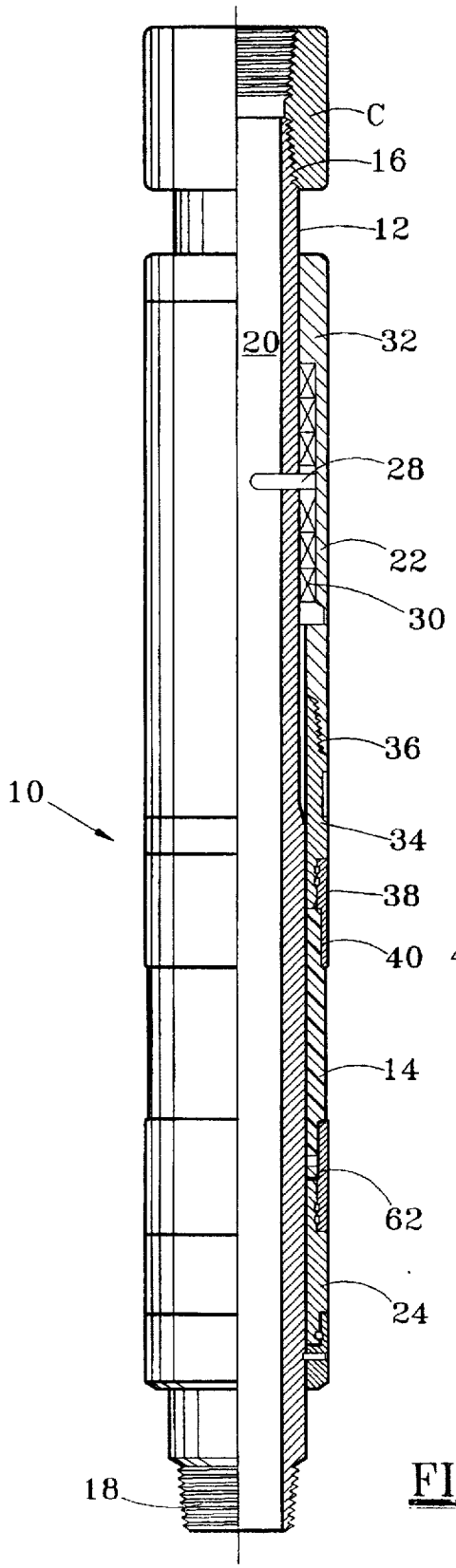
FIG. 1 is a quarter sectional view of an external casing packer according to the present invention.

FIG. 1 illustrates an external casing packer 10 according to the present invention. The packer includes a mandrel 12 and an inflatable elastomeric sealing element 14 radially outward of a mandrel 12. The packer 10 also includes an upper collar 22 and a lower collar 24 discussed further below. The upper end of the mandrel 12 is threaded at 16 for engagement with a conventional oilfield coupling C, and the lower end of the mandrel has similar threads 18. The packer is connected to a casing string (not depicted), so that the mandrel 12 is an integral part of the string. The uniform cylindrical bore 20 within the mandrel 12 is sized to be substantially equal to the bore of the casing string. The packer 10 thus does not create an impediment to the passage of wireline tools and/or working strings through the casing packer when in neither the set or unset position. Accordingly, conventional wireline tools, conventional threaded work strings, or coil tubing work strings may be easily passed through the packer 10.

Those skilled in the art will appreciate that the packer as shown in FIG. 1 may have an axial length of approximately five meters. Since the sealing element itself may have an axial length of approximately three meters, the sealing element as depicted in FIG. 1 is axially abbreviated, which is conventional for figures depicting threadable packers. The packer may be sized for interconnection with conventional casing which varies from 2⅜" to 20" or more, which is the approximate outer diameter of the mandrel 12. The packer has a body O.D., which is the outer diameter of the upper collar 22 and the lower collar 24, which typically is slightly greater than the diameter of the mandrel 12. The sealing element 14 when run in the well may have the same outer diameter as the collars. A suitable external casing packer according to this invention may be similar to the Model CMX-10 External Casing Packer, Product No. 301-23, manufactured by Baker Oil Tools, although the concept of the present invention can be used on various types of inflatable packers.

The upper and lower collars, 22, 24, are positioned outside the mandrel 12 and are mechanically coupled thereto in a conventional manner, typically by threads. One of the collars, preferably the upper collar 22, include the plurality of valves therein for regulating fluid flow to set and unset the elastomeric sealing element 14. Conventional well fluids may be used to inflate the element 14. In some applications, the fluid may be a cement slurry which hardens in the set casing packer for permanent applications. Element 14 thus is deformed radially outward in response to fluid pressure and into gripping and sealing engagement with the open-hole wellbore. An inflation chamber is formed between the outer diameter of the mandrel 12 and the sealing element 14. Fluid thus passes through the annulus 26 (see FIG. 2) of the upper collar, then downward to inflate the elastomeric sealing element 14. The pump located either at this surface or within the wellbore generates a desired level of fluid pressure, which is transmitted downward through the interior of the casing string or through a work string and into the mandrel 12. The pressurized fluid passes through the inlet port 28 in the mandrel 12, then past the valve assembly 30 housed within the upper collar 22. Further details regarding a preferred valve assembly for setting and unsetting of the external casing packer are disclosed in U.S. Pat. No. 5,241,369, hereby incorporated by reference.

As shown in FIG. 1, the valve collar 22 may include an axially elongate upper portion 32 which houses the valves 30, and a lower sub 34 which is threaded at 36 to the upper portion 32. The O.D. of lower sub 34 preferably is the same as the packer body diameter, and the inner diameter of sub 34 is only slightly greater than the O.D. of the mandrel 12, thereby forming the chamber 26 for inflating the packer. The lower end 38 of the sub 34 has a reduced outer diameter to fit radially within the upper end sleeve 40. End sleeve 40 is interconnected with the upper end of an elastomeric sleeve-shaped seal or boot 15 in a conventional manner. If the sealing element employs metal ribs (not shown) for increasing the packer working pressure, the ends of the metal ribs may be welded or otherwise secured directly to the end sleeve 40. The end sleeve, elastomeric boot and the optional metal ribs together thus form the elastomeric sealing element.

Figure 2:
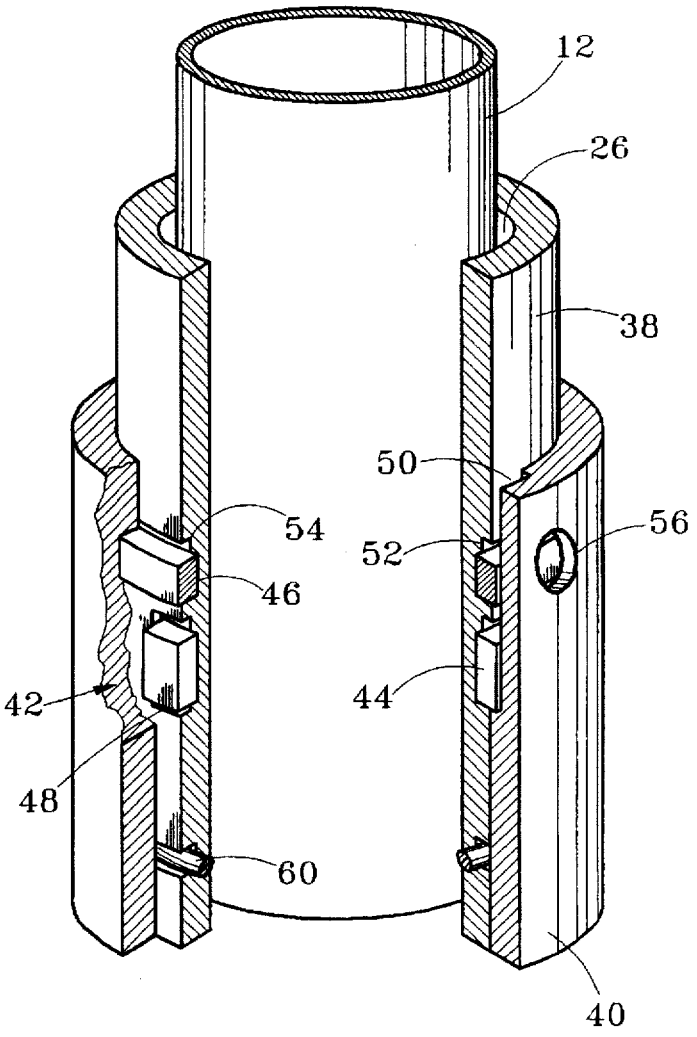
FIG. 2 is a pictorial view, partially in cross section, illustrating a square wire interconnection between the upper sealing element end sleeve and the upper collar of an inflatable packer according to the present invention.

FIG. 2 illustrates a suitable connection mechanism 42 for mechanically interconnecting the lower end 38 of sub 34 (and thus the collar 22) with the upper end of end sleeve 40 (and thus the elastomeric sealing element 14). Connection mechanism 42 includes a plurality of the circumferentially spaced anti-rotational keys 44 and a retaining wire 46. Each anti-rotational key 44 is fitted within a respective recess 48 cut in the outer surface of the lower end 38 of sub 34, and has a slightly curved and generally rectilinear configuration. Typically four, six, or eight such anti-rotational keys and recesses are axially spaced about the circumference of the sub 34. A similar number of axially elongate slots 50 are cut into the upper end of the inner surface of the end sleeve 40. When the collar 22 is moved axially so that the lower end 38 of sub 34 fits within the upper end of end sleeve 40, the keys 44 and the slots 50 cooperate to prevent rotation between the end sleeve 40 and the collar 22. Keys 44 engage the lower end of the slot 50 and may limit axial movement of the collar 22 relative to the end sleeve 40.

A circumferential groove 52 and a similar groove 54 are formed in the outer surface of the member 38 and the inner surface of the member 40, respectively, as shown on FIG. 2. The grooves are positioned to be axially aligned when the keys 44 engage the end of the slot 50. An inclined insertion hole 56 is provided through the sleeve 40 for passing a wire 46 from the exterior of the sleeve through the hole 56 and into the grooves 52 and 54, thereby axially retaining the collar to the end sleeve. A conventional O-ring 60 seals between the lower end 38 of sub 34 and end sleeve 40 to retain pressurized fluid within the inflated boot 15.

The length of the installed wire 46 is only slightly less than the circumferential length of the grooves 52 and 54. During installation, the wire 46 may be longer than the circumference of the groove, but preferably is cut off during installation to fit within the groove. Preferably the wire 46 is positioned about at least 210° of the circumference between the members 38 and 40, and preferably about at least 270° of the circumference between these members. When the packer is being pressure tested, the wire 46 may be inserted through the hole 56 and into the grooves 52 and 54, although a portion of the wire may extend radially outward from the hole 56 during the pressure testing. If the pressure test is positive indicative of no leaks from the pressure chamber, the wire 46 may then be completed inserted so that it fits entirely within the grooves 52 and 54, and practically cannot thereafter be withdrawn. If the pressure test is negative indicative of a leak, the wire 46 may be easily withdrawn, the packer disassembled, the leak corrected, then the packer reassembled and retested.

It should be understood that the size and number of the anti-rotational keys 44 may be selected to obtain the desired torque rating necessary to transmit torque to the sealing element 14. Similarly, although only one wire 46 is shown on FIG. 1, both the number and size of the wire may be selected so that the desired axial load can be transmitted from the casing string through the mandrel and to the elastomeric sealing element 14. Wire 46 preferably has a rectangular cross sectional configuration as shown in FIG. 2 for fitting within a similarly configured passageway formed by the combined grooves 52 and 54. This rectangular configuration maximizes the mechanical integrity of the axial connection between the collar and the end sleeve while minimizing the radial depth of the grooves cut in the members 38 and 40. Other cross-sectional configurations for wire could be employed, if desired.

According to the method of the present invention, an improved technique is provided for interconnecting an elastomeric sealing element end sleeve with a collar of an inflatable packer of a type described herein. A circumferential collar groove is formed in the radially outer surface of the collar, and a similar groove is formed in the radially inner surface at the end sleeve. A wire insert hole is drilled in the end sleeve, preferably at a deviated or inclined angle with respect to a conventional radially drilled hole, in order to facilitate the subsequent insertion of the wire through the hole and into the groove. The inclined hole obviously is in communication with the sleeve groove and, as previously noted, the sleeve groove is aligned with and in communication with the collar groove. The retaining wire is then inserted through the wire insert hole and into both the collar groove and the sleeve groove to axially interconnect the collar with the end sleeve. The overall length of the wire is such that the wire occupies at least 210° of the circumference of the respective end collar. A seal is positioned axially between the retaining wire and the elastomeric seal 15 for sealing between the collar and the end sleeve.

In order to rotationally interconnect the collar with the end sleeve, one or more cut-outs may be formed within an outer surface of the collar, and an anti-rotational key fitted within each cut-out. An axially extending slot is cut in the outer surface of the respective end sleeve. The collar is slid into the end sleeve such that each key fits within a respective slot, thereby rotationally locking the collar to the end sleeve.

It is conventional to test the inflatable packer before shipping the packer to the field for use downhole. According to the prior art, the packer is pressure tested, and if the test is negative indicative of a leak, the weld between the end sleeve and the collar must be removed and the packer disassembled. According to the present invention, a front portion of the retaining wire is inserted in the collar groove and the sleeve groove while a rear portion of the retaining wire extends radially outward from the wire insert hole. At this stage, the chamber is pressurized to test the sealing integrity of the pressurized chamber. In response to a positive test, the rear portion of the retaining wire is slid through the retaining hole and into both the collar groove and the sleeve groove, such that the retaining wire cannot practically thereafter be withdrawn. Assuming the test is negative indicative of a leak from the pressure chamber, the rear portion of the retaining wire extending from the insert hole allows the entire retaining wire to be easily withdrawn from the collar groove and the sleeve groove. The packer may thus be easily disassembled, repaired and then retested.

In an alternative pressure testing operation, the retaining wire may be installed completely in the groove between the collar and the sleeve. Assuming the pressure test is positive, the retaining wire may then be left in place. If the pressure test is negative, the end of the retaining wire may be designed so that it can be grasped by a needlenose pliers or other conventional tool for removal from the groove.

As previously noted, the technique for interconnecting the elastomeric sealing element end sleeve with the collar may be used for interconnecting both the upper end sleeve with the upper collar and the lower end sleeve with the lower collar, or may be used for interconnecting only a selected one of the end sleeves with a respective collar. While it is preferable according to the present invention to rotationally lock the end sleeve to the collar, the plurality of anti-rotational keys as disclosed herein, the plurality of the cut-outs in the outer surface of the collar, and the plurality of axially extending slots in the inner surface of the end sleeve may be eliminated for those applications wherein it is not necessary to apply torque to the elastomeric sealing element.

Those skilled in the art will appreciate that the cost of manufacturing the grooves in the collar and the end sleeve are reduced by providing a groove which lies within a plane perpendicular to the central axis of the packer. Alternatively, however, a groove could be machined in both the collar and end sleeve so that the installed retaining wire would have the configuration of a spiral when positioned in the groove. An advantage of this spiral groove design is that the retaining wire which provides axial interconnection between the collar and the end sleeve would also serve to transmit torque between the collar and the end sleeve, so that the anti-rotation keys previously discussed may be eliminated. Also, two oppositely directed spiralling grooves and retaining wires may be used in order to torque balance the connection between the collar and the groove.

As previously noted, both the interconnecting wire and each of the grooves in the collar and the end sleeve may have a cross-sectional configuration which is not rectangular. The grooves in the collar and the end sleeve could be combined to form a groove with a double dovetail configuration, so that a retaining wire with a cross-section in a general shape of an hour glass could be inserted into the double dovetail groove. This configuration of the groove and the wire would minimize the likelihood of the collar expanding and jumping over the wire. While a wire is a preferred member for axially interconnecting the collar and the end sleeve, it should be understood that multiple wire segments rather than a single elongate wire may be provided in the groove for interconnecting the collar to the end sleeve.

Instead of using a wire, roller bearings or ball bearings may be positioned in the groove for interconnecting the collar and the end sleeve. Bearing-type interconnection members may be retained within the groove by plugging a bearing member insertion hole, similar to hole 56, provided in the sleeve. After unplugging the hole, the bearing members may be easily removed to allow axial movement between the collar and the end sleeve. Another alternative to the retaining wire would be to use slurry which was injected into the groove through a hole in the end sleeve. The slurry would then fill the groove and harden to secure the collar to the end sleeve. Any number of plastics or epoxies may be used as a suitable slurry for injecting into the groove to retain the collar to the end sleeve.

While preferable to insert the collar-to-end sleeve retaining member from the outside and through a hole in the end sleeve then into the groove, it is also possible to provide an insertion hole in the collar so that the retaining member could be inserted from the interior of the tool. This arrangement may be preferred if bearing members are used to interconnect the end sleeve to the collar, or if a plastic or epoxy injection compound is injected into the groove. Various types of seals may be used to sealing between the collar and the sleeve other than the O-ring seal 60 generally shown in FIG. 2. Metal O-rings, metal U-rings, and other non-elastomeric sealing members which provide reliable sealing engagement in downhole tools may thus be used for sealing between the collar and the end sleeve.

Figure 3:
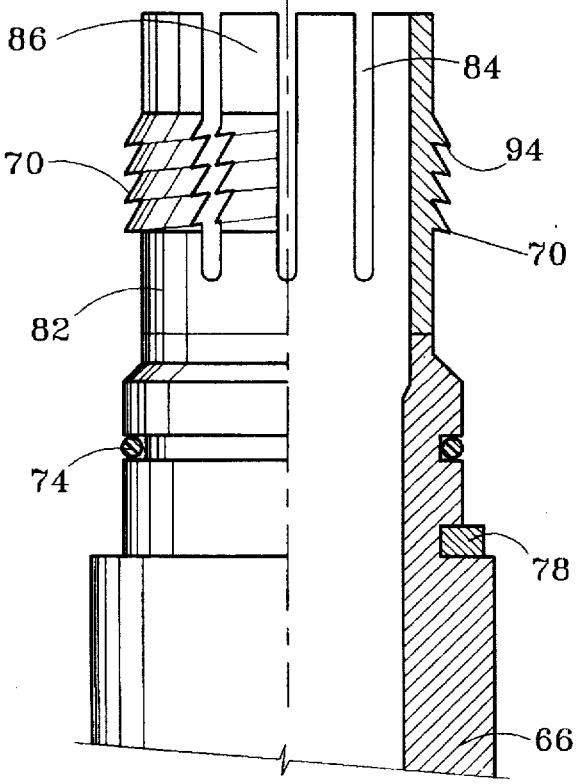
FIG. 3 is a pictorial view, partially in cross-section, illustrating a collet mechanism for interconnecting a lower sealing element end sleeve and the lower collar of an inflatable packer.

FIG. 3 discloses an alternative embodiment for interconnecting the end sleeve and a collar. The collet mechanism 62 interconnects the end sleeve 64 and the collar 66. In the FIG. 3 embodiment, the sleeve 64 is a lower end sleeve which is secured to an elastomeric sealing element or boot 14 of the type generally shown in FIG. 1, and thus the collar 66 is a lower collar which functionally replaces the collar 24 shown in FIG. 1. As previously noted, conventional valves 30 may be housed in either the upper collar or the lower collar, or both.

The sleeve 64 includes a series of spirally threads or teeth 68 along an inner surface thereof for mating engagement with corresponding threads or teeth 70 on the outer surface of collar 66. A lower cylindrical surface 72 on the sleeve is provided for sealed engagement with seal 74 on the collar, thereby preventing inadvertent loss of pressurized fluid from the inflated sealing element. A plurality of circumferentially spaced generally rectilinear slots 76 may be provided in the lowermost end of the sleeve 64 each for receiving a corresponding generally rectilinear key 78, thereby rotatably interconnecting the end sleeve and the collar and allowing torque to be transmitted to the inflatable sealing element of the packer. The plurality of anti-rotational keys 78 and the corresponding slots 76 may be eliminated, if desired, under circumstances where it is satisfactory to allow the inflatable sealing element of the packer to remain stationary within a rotating mandrel.

The upper sleeve-shaped end 82 of the collar 66 includes a plurality of elongate slots 84 extending to the upper end of the collar, thereby forming circumferentially spaced collet members 86 with external teeth 70 thereon. Those skilled in the art appreciate that the slots 84 may be cut in the collar after the teeth 70 are formed, and that each collet member 86 may deflect radially inward toward packer axis 88. Both the teeth 68 and 70 may have a reverse or negative angle profile, such that surface 90 on teeth 68 is at a slight negative angle 92 with respect to a plane perpendicular to axis 88. A mating surface 94 on teeth 70 has a similar negative angle, thereby ensuring that the sleeve and the collar remain interconnected even when high axial forces are transmitted between these components. Minimum cold working of the sleeve or collar is required, thereby minimizing the likelihood of concentrated stresses and thus reducing corrosion and cracking.

During assembly, the sleeve 64 and the collar 66 are moved axially together, with a collet members 86 deflecting radially inwardly while the teeth 70 jump passed the teeth 68. No rotation is required to interconnect the collar to the end sleeve, thereby eliminating alignment problems which may be caused by an assembly technique which requires the rotation of the inflatable sealing element. Once interconnected, the sealing integrity of the elastomeric element may be pressure tested, as previously described. In the event of leakage past the seal 74 or past the corresponding seal between the upper end sleeve and the upper collar, the collar 66 may be rotated to unthread the mating connection provided by threads 68 and 70. Thus the collar and end sleeve may be axially interconnected and pressure tested, and the end sleeve and collar easily disconnected in the event of a failed pressure test. If the pressure test indicates that there is no leakage, the collar 66 may still be unthreaded one or two turns with respect to the end sleeve 64, and anti-rotational keys 78 then circumferentially positioned about the collar each for alignment with a corresponding slot 76 in the end sleeve. The collar and end sleeve may then be moved axially together as previously described, thereby axially interconnecting the collar and end sleeve with the threads 68 and 70, and with the anti-rotational keys 78 rotationally locking the end sleeve to the collar.

Figure 4:
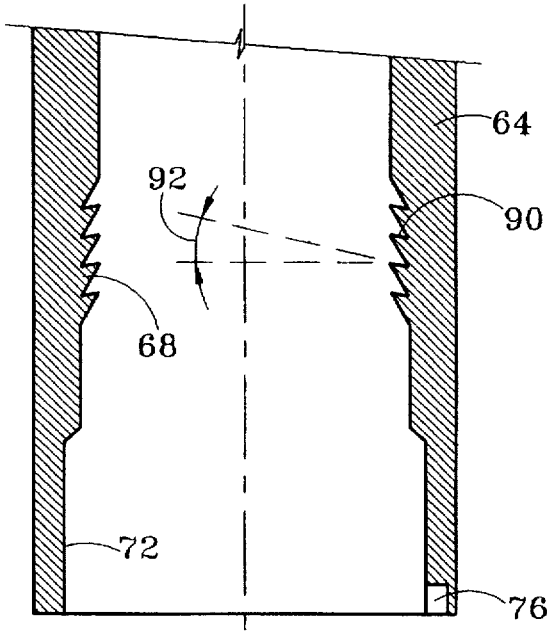
FIG. 4 is a pictorial view, partially in cross-section, illustrating a swage connection between the lower sealing element end sleeve and the lower collar of an inflatable packer.
Figure 4:
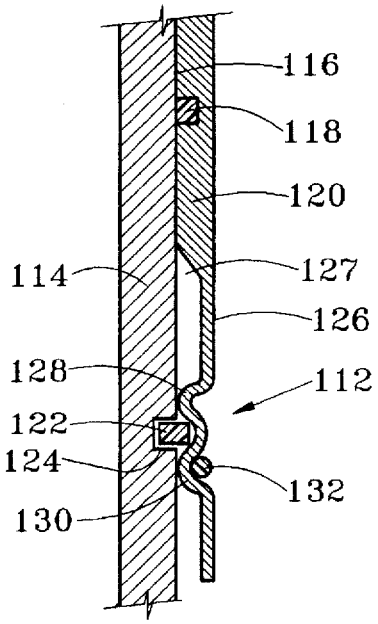
Figure 5:
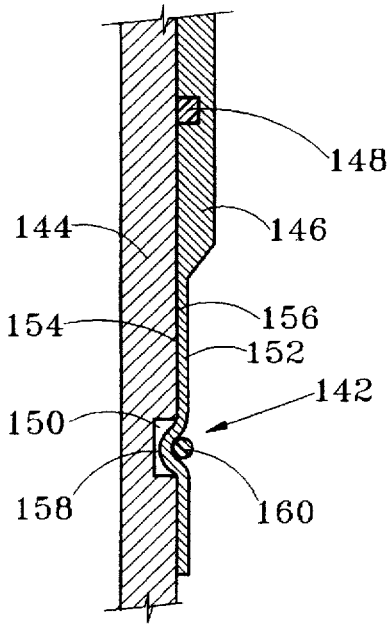
FIG. 5 is a side view of an alternative embodiment of the swage connection shown in FIG. 4.

FIGS. 4 and 5 disclose alternate embodiments for interconnecting an inflatable sealing element end sleeve with a collar. Swage or crimp connections 112 and 142 are each illustrated between a lower collar and a lower end sleeve of an inflatable sealing element. The same connection provided between the lower collar and the lower end sleeve would normally be used to interconnect the upper collar and the upper end sleeve, although different combinations of connections as disclosed herein may be used for interconnecting an end sleeve within a respect collar. The lower collar 114 as shown in FIG. 4 includes a cylindrical outer surface 116 for engagement with annular seal 118 provided in the end sleeve 120. A radially outward annular projecting member from the surface 116 may be provided by positioning an annular ring 122 having a generally rectangular cross-sectional configuration within annular groove 124 in the collar 114. Various cross-sectional configurations for a ring 122 may be used, and the desired radially outward projection need not be an annular member. Also, the radially outward projection may, but need not be, rotationally fixed to or may be an integral component of the collar 114.

The lower end 126 of the end sleeve 120 has reduced thickness, thereby forming an annular cavity 127 between 126 and 114. When initially formed, the lower end 126 is sleeve-shaped, so that the collar 114 and the end sleeve 120 may be moved axially together with the sleeve-shaped lower end 126 easily passing by the ring 122. Once the end sleeve 120 is desirably positioned axially with respect to the collar 114, conventional swaging or crimping tool may be used to form annular indentation 128 immediately above ring 126, and annular indentation 130 immediately below ring 122, thereby axially interconnecting the end sleeve and the collar. To enhance the reliability of the interconnection, a split ring 132 may be positioned within the annular external groove formed by the indentation 130. The ends of the annular split-ring 132 may then be welded together to form a solid ring. Since the solid ring 132 has a diameter less than the outer diameter of ring 122, the components are securely interconnected. A similar split ring may be provided for the upper indentation 128, although generally the axial forces transmitted between the elastomeric sealing element and the lower collar 114 are such that an upward force is applied to the lower end sleeve 120 relative to the lower collar 114, and accordingly a single ring 132 below the ring 122 would normally be necessary. If desired, additional axially spaced rings 122 and corresponding lower indentations 130 and rings 132 may be provided for further enhancing the structural interconnection between the collar and the end sleeve.

Various conventional tools may be used to form the swage or crimped connection provided by the indentations 128 and 130, as shown in FIG. 4. A conventional pipe cutter with a blunt roller may be used for providing the desired interconnections. Alternatively, the interconnections could be formed when the roller and end sleeve are mounted on a lathe, and a roller is then used to form the annular indentations 128 and 130. The seal 118 is preferably provided for ensuring sealing integrity between the collar 114 and the end sleeve 120, thereby preventing the escape of fluid from the inflated elastomeric sealing element. As an alternative to the seal 118, however, the annular indentations formed by the swage connection of the present invention may be sufficient to provide a metal-to-metal seal between the collar and the end sleeve. The material for the split ring 130 is not particularly critical since it must only ensure that the indentation 130 not expand to slip axially by the ring 122. No pre or post heating of the ring 132 should be required.

FIG. 5 discloses an alternate swage or crimp connection 142 between lower collar 144 and lower end sleeve 146. An annular seal 148 is equivalent to seal 118 previously discussed. An annular groove 150 is formed within the lower collar, and the lower end 152 of the end sleeve 146 has a reduced thickness to accommodate the swaging operation. In this case, however, the outer material of the end sleeve is removed to form the reduced thickness lower end 152. During assembly, the inner surface 154 of the sleeve-shaped lower end 152 thus slides along the outer surface 156 of the collar 144, so that the lower end 152 moves passed the groove 150 and to a desired axial position of the sleeve 146 with respect to the collar 144.

A swaging or crimping tool is then used to form annular indentation 158, thereby pressing a portion of the lower end 152 of the sleeve radially inward and into groove 150, as shown in FIG. 5. To enhance the inner connection between the sleeve and the collar, a split ring 160 may be positioned along the exterior groove formed by the indentation 158. The ends of the split ring may then be welded together to form a solid ring, as previously discussed. The inner diameter of the ring 160 is less than the diameter of the surface 156 of the collar or 144, so that the solid ring 160 reliably maintains the indentation 158 within the groove 150 even when high axial forces are transmitted between the elastomeric sealing element and the collar.

In both the FIG. 4 and FIG. 5 embodiments, one or more keys may be used to rotationally interconnect the respective collar to the end sleeve so that torque may be transmitted through the elastomeric sealing element of the packer. If it is satisfactory to allow the elastomeric sealing element to rotate relative to the mandrel, the anti-rotational keys need not be used.

Although the invention has been described with reference to specific embodiment, this description is not intended to be construed as limiting. Various modifications of the disclosed embodiment as well as alternative embodiments of the invention will become apparent to persons skilled in the art upon review of the above description. The invention is intended to cover such modifications and embodiments that are within the scope of the invention, as defined by the following claims.

What is claimed is:

1. An inflatable packer for positioning downhole along the tubular string in a well, comprising:

a mandrel for interconnection with the tubular string, the mandrel having a throughbore therein for communication with the tubular string;

an elastomeric sealing element radially outward of the mandrel;

a pressurized chamber radially between the mandrel and the elastomeric sealing element for inflating the sealing element into sealing engagagement with a wall within the well;

an upper collar axially above the sealing element and radially outward of the mandrel;

a lower collar axially below the sealing element and radially outward of the mandrel;

an upper end sleeve interconnected with an upper end of the sealing element and radially outward of the mandrel;

a lower end sleeve interconnected with a lower end of the sealing element and radially outward of the mandrel;

a circumferential collar groove in a radially outer surface of at least one of the upper collar and lower collar;

a circumferential sleeve groove in a radially inner surface of a respective one of the upper end sleeve and lower end sleeve; and a retaining member extending radially between the collar groove and the sleeve groove to axially interconnect the at least one of the upper collar and lower collar with the respective one of the upper end sleeve and lower end sleeve, the retaining member being positioned entirely within the circumferential collar groove and the circumferential sleeve groove to permanently interconnect the respective collar and sleeve.

2. The inflatable packer as defined in claim 1, further comprising:

one or more anti-rotational members for rotationally interconnecting the at least one of the upper collar and lower collar with a respective one of the upper end sleeve and lower end sleeve.

3. The inflatable packer as defined in claim 1, further comprising:

at least one of the upper end sleeve, the lower end sleeve, the upper collar, and the lower collar having an insert hole therein for passing the retaining member into both the collar groove and the sleeve groove, the retaining member having a substantially circular configuration and positioned radially interior of the insert hole.

4. The inflatable packer as defined in claim 1, wherein the circumferential collar groove and the circumferential sleeve groove each lie substantially within a plane perpendicular to a central axis of the mandrel.

5. The inflatable packer as defined in claim 1, further comprising:

a seal for sealing between the at least one of the upper collar and lower collar and the respective one of the upper end sleeve and lower end sleeve.

6. The inflatable packer as defined in claim 1, wherein:

the collar groove and the sleeve groove together form a combined groove having a generally rectangular cross-sectional configuration; and the retaining member is a wire having a generally rectangular cross-sectional configuration for substantially filling the combined groove cross-sectional configuration.

7. The inflatable packer as defined in claim 6, wherein the retaining wire extends about at least 210° of the circumference of the respective one of the upper end sleeve and lower end sleeve.

8. The inflatable packer as defined in claim 1, wherein at least one of the upper collar and the lower collar includes a plurality of valves for controlling fluid flow between the throughbore in the mandrel and the pressure chamber.

9. The inflatable packer as defined in claim 2, wherein the one or more anti-rotational members further comprises:

a plurality of cut-outs each extending into an outer surface of the at least one of the upper collar and lower collar and circumferentially about the at least one of the upper collar and lower collar;

a corresponding plurality of anti-rotational keys each for fitting within a respective one of the plurality of cut-outs; and a corresponding plurality of axial extending slots in the inner surface of a respective one of the upper end sleeve and lower end sleeve for receiving a respective one of the plurality of anti-rotational keys.

10. An inflatable packer for positioning within the tubular string in a well, comprising:

a mandrel for interconnection with the tubular string, the mandrel having a throughbore therein;

an elastomeric sealing element radially outward of the mandrel, the elastomeric sealing element including an end sleeve;

a pressurized chamber radially between the mandrel and the elastomeric sealing element for inflating the sealing element into sealing engagement with the sidewall of the well;

a collar positioned axially opposite the sealing element with respect to the end sleeve and radially outward of the mandrel;

a circumferential collar groove in a radially outer surface of the collar;

a circumferential sleeve groove in a radially inner surface of the end sleeve;

a wire insert hole passing radially through one of the collar and the end sleeve for passing a retaining wire into both the collar groove and the sleeve groove; and a retaining wire circumferentially extending in both the collar groove and the sleeve groove to axially interconnect the collar with the end sleeve, and positioned radially interior of the insert hole.

11. The inflatable packer as defined in claim 10, further comprising:

a seal positioned axially between the retaining wire and the elastomeric seal for sealing between the collar and the end sleeve.

12. The inflatable packer as defined in claim 10, wherein:

the collar groove and the sleeve groove together form a combined groove having a generally rectangular cross-sectional configuration; and the retaining wire as a rectangular cross sectional configuration for substantially filling the combined groove cross-sectional configuration.

13. The inflatable packer as defined in claim 10, wherein the retaining wire extends about at least 210° of the circumference of the end sleeve.

14. The inflatable packer as defined in claim 10, further comprising:

a plurality of cut-outs each extending into an outer surface of the collar and circumferentially about the collar;

a corresponding plurality of anti-rotational keys each for fitting within a respective one of the plurality of cut-outs; and a corresponding plurality of axial extending slots in the inner surface of the end sleeve for receiving a respective one of the plurality of anti-rotational keys.

15. The inflatable packer as defined in claim 11, further comprising:

one or more anti-rotational members for rotationally interconnecting the collar with the end sleeve.

16. An inflatable packer for positioning within the tubular string in a well, comprising:

a mandrel for interconnection with the tubular string, the mandrel having a throughbore therein;

an elastomeric sealing element radially outward of the mandrel, the elastomeric sealing element including an end sleeve;

a pressurized chamber radially between the mandrel and the elastomeric sealing element for inflating the sealing element into sealing engagement with the sidewall of the well;

a collar positioned axially opposite the sealing element with respect to the end sleeve and radially outward of the mandrel;

one or more anti-rotational members for rotationally interconnecting the collar with the end sleeve;

end sleeve teeth on an inner surface of the end sleeve;

collar teeth on an outer surface of the collar for mating engagement with the end sleeve teeth; and one of the end sleeve and collar having collet members for radially deflecting to allow the end sleeve teeth to pass by the collar sleeve teeth as the end sleeve and the collar are moved axially together.

17. The inflatable packer as defined in claim 16, wherein both the end sleeve teeth and collar sleeve teeth are inclined with respect to a central axis of the mandrel for disconnecting the end sleeve from the collar by unthreading the mating teeth.

18. The inflatable packer as defined in claim 16, wherein the collet members are provided on the collar.

19. The inflatable packer as defined in claim 16, further comprising:

one or more anti-rotational members for rotationally interconnecting the collar with the end sleeve.

20. The inflatable packer as defined in claim 16, further comprising:

a seal for sealing between the collar and the end sleeve.

21. An inflatable packer for positioning within the tubular string in a well, comprising:

a mandrel for interconnection with the tubular string, the mandrel having a throughbore therein;

an elastomeric sealing element radially outward of the mandrel, the elastomeric sealing element including an end sleeve;

a pressurized chamber radially between the mandrel and the elastomeric sealing element for inflating the sealing element into sealing engagement with the sidewall of the well;

a collar positioned axially opposite the sealing element with respect to the end sleeve and radially outward of the mandrel;

a circumferential groove in a radially outer surface of the collar; and an annular radially inward swage indentation in the end sleeve for cooperating with the circumferential groove in the outer surface of the collar to axially interconnect the collar and the end sleeve; and an annular ring for engaging the swage indentation to enhance the interconnection between the collar and the end sleeve.

22. The inflatable packer as defined in claim 21, further comprising:

an interconnection member extending radially outward from an outer surface of the collar for engagement with the annular swage indentation.

23. The inflatable packer as defined in claim 21, wherein a portion of the end sleeve axially adjacent the swage indentation has a reduced radial thickness relative to another portion of the end sleeve axially spaced from the swage indentation.

24. A method of interconnecting an elastomeric sealing element end sleeve with a collar of an inflatable packer, the packer including a mandrel having a throughbore therein, the elastomeric sealing element being radially outward of the mandrel, and a pressurized chamber radially between the mandrel and the elastomeric sealing element for inflating the sealing element into sealing engagement with the side wall of a well, the method comprising:

forming a circumferential collar groove in a radially outer surface of the collar;

forming a circumferential sleeve groove in a radially inner surface of the end sleeve;

forming an insert hole through one of the end sleeve and the collar; and inserting a retaining member through the insert hole and into both the collar groove and the sleeve groove to axially interconnect the collar with the end sleeve, such that the retaining member resides entirely within both the collar groove and the sleeve groove and radially inward of the insert hole.

25. The method as defined in claim 24, wherein inserting the retaining member comprises:

positioning a retaining wire about at least 210° of the circumference of the end sleeve.

26. The method as defined in claim 24, wherein inserting the retaining member comprises:

positioning a front portion of a retaining wire in both the collar groove and the sleeve groove while a rear portion of the retaining wire remains outward from the wire insert hole;

pressurizing the pressurized chamber to test the sealing integrity of the pressurized chamber; and in response to the test, thereafter either positioning the rear portion of the retaining wire within the collar groove and the sleeve groove or removing the retaining wire from the collar groove and sleeve groove to repair a leak in the pressurized chamber.

27. The method as defined in claim 24, further comprising:

forming a cut-out in an outer surface of the collar;

positioning an anti-rotational key within the cut-out;

forming an axially extending slot in the inner surface of the end sleeve; and sliding the collar into the end sleeve such that the key fits within the slot to rotationally interconnect the collar and the end sleeve.

28. The method as defined in claim 24, further comprising:

rotationally interconnecting the end sleeve and the collar with one or more anti-rotational members.

* * * * *